US005354163A

United States Patent [19]

Mori et al.

[11] Patent Number: 5,354,163

[45] Date of Patent: Oct. 11, 1994

[54] THREE-DIMENSIONAL PARKING FACILITY

[75] Inventors: Kunio Mori, Mie; Sigeru Suzuki, Osaka; Fusako Suzuki, Osaka; Hisayo Minamide, Osaka; Yusako Sakai, Osaka; Nobuo Suzuki, Osaka; Takayo Hamazaki, Osaka; Makoto Takahashi, Hyogo; Michiko Kume, Tokyo, all of Japan

[73] Assignee: Shin-Ichi Suzuki, Osaka, Japan

[21] Appl. No.: 3,214

[22] Filed: Jan. 12, 1993

Related U.S. Application Data

[63] Continuation of Ser. No. 705,973, May 28, 1991, abandoned.

[30] Foreign Application Priority Data

May 25, 1990 [JP] Japan ..... 2-136245
Feb. 15, 1991 [JP] Japan ..... 3-022095

[51] Int. Cl.[5] ..... E04H 6/06

[52] U.S. Cl. ..... 414/229; 414/228; 414/234; 52/175

[58] Field of Search ..... 52/175; 414/227, 228, 414/229, 230, 233, 234, 242, 243, 252, 258, 261; 410/26; 14/71.3, 71.5, 71.7; 187/8.52

[56] References Cited

U.S. PATENT DOCUMENTS

| | | | |
|---|---|---|---|
| 3,712,485 | 1/1973 | Klaus | 414/229 |
| 3,924,760 | 12/1975 | Lendi | 414/229 |
| 3,941,257 | 3/1976 | Matsuura | 414/229 X |

FOREIGN PATENT DOCUMENTS

| | | | |
|---|---|---|---|
| 2009649 | 11/1971 | Fed. Rep. of Germany | 414/229 |
| 2301428 | 7/1974 | Fed. Rep. of Germany | 414/229 |
| 2355153 | 5/1975 | Fed. Rep. of Germany | 414/229 |
| 2644022 | 4/1978 | Fed. Rep. of Germany | 414/228 |
| 3443000 | 4/1986 | Fed. Rep. of Germany | 414/229 |
| 622309 | 3/1981 | Switzerland | 414/229 |

*Primary Examiner*—Frank E. Werner
*Attorney, Agent, or Firm*—Armstrong, Westerman, Hattori, McLeland & Naughton

[57] ABSTRACT

A three-dimensional parking facility which includes an upper parking portion and a lower parking portion. The three-dimensional parking facility further includes a device for swinging the upper parking portion and the lower parking portion. The swinging device is supported by a member running along a horizontal axis on a solid foundation.

10 Claims, 5 Drawing Sheets

THREE-DIMENSIONAL PARKING FACILITY

This application is a continuation of application Ser. No. 07/705,973 filed May 28, 1991, now abandoned.

BACKGROUND OF THE INVENTION

1. Field of the Invention

The present invention generally relates to a parking facility with a three-dimensional structure which includes an upper parking space and a semi-underground lower parking space.

2. Description of the Relevant Art

As disclosed in the Official Gazette Jikkai Sho60-102365, in the conventional three-dimensional parking facilities, the floors of both the upper and lower parking spaces move vertically in parallel; thus, enabling automobiles to enter and leave.

The conventional structure, as mentioned above, requires a space, such as an underground pit, which is dug into the ground in the shape of a rectangular prism in order for the lower portion to descend. As more volume is dug the more it costs in terms of expense and labor, the conventional three-dimensional parking facilities have the disadvantage of costing much money and labor.

Another problem in the conventional device is that if the pit is dug deeply, it becomes more humid and more easily submerged which makes a shallow structure more favorable. On the other hand, if it is too shallow, it becomes difficult for an automobile to enter and leave the upper portion.

In order to solve this dilemma in the conventional device, a three-dimensional parking facility which requires lesser space underneath should be provided.

SUMMARY OF THE INVENTION

In order to decrease the amount of digging which will secure a smaller amount of space, the present invention, instead of moving vertically in parallel, lets one side thereof sway vertically around a horizontal axis.

In other words, the present invention is a three-dimensional parking facility having a structural arrangement which includes an upper parking space and a lower parking space, whereby the swaying structure is supported by a member along a first horizontal axis placed at a solid foundation with a main swinging system which sways the parking structure.

Alternatively, while the member along the first horizontal axis on the solid foundation can support the parking structure with the main swinging system which sways the structure, the upper parking space can be separated into a front portion and a rear portion by a member along a second horizontal axis and the front swinging system sways the front portion.

While the first horizontal axis on the solid foundation can support the parking structure with the main swinging system which sways the structure, the upper parking space can be separated into the front portion and the rear portion by the member along the second horizontal axis and the front swinging system which sways the front portion and a joint material which sways the lower portion in accordance with the swaying of the front portion can be attached thereto.

While the member along the first horizontal axis on the solid foundation can support the parking structure with the swaying system which sways the structure, the upper parking space can be separated into the front portion and the rear portion above a windshield of an automobile which is to be parked on the lower portion. The member along the second horizontal axis which supports the front portion and swings the front according to the rear with the front swinging system which sways the front portion can be attached thereto.

Another alternative structural arrangement of this invention is hereinafter described. While the member along the first horizontal axis on the solid foundation can support the parking structure with the main swinging system which sways the structure, the upper parking space can be separated into the front portion and the rear portion above a windshield of an automobile which is to be parked on the lower portion. The member along the second horizontal axis supports the front portion and sways the front according to the rear with the front swinging system which sways the front part supplemented with the joint material which sways the lower portion in accordance with the swinging of the front portion.

While the member along the first horizontal axis on the solid foundation can support the parking structure with the swaying system which sways the structure, the upper parking space can be separated into the front portion and the rear portion above a windshield of an automobile which is to be parked on the lower portion. The member along the second horizontal axis supports the front portion and swings the front according to the rear with the front swinging system which sways the front portion. In addition, the front swinging system which sways the front portion between a substantially horizontal position and a forward sloping position against the rear part can be attached, as well as a movable slope member, which sways freely around the third horizontal axis at the top of the front portion. This movable slope member sways, by the slope-swinging system, between a substantially vertical position and a forward sloping position.

While the member along the first horizontal axis on the solid foundation can support the parking structure with the swaying system which sways the structure, the upper parking space can be separated into the front portion and the rear portion above a windshield of an automobile which is to be parked on the lower portion. The member along the second horizontal axis supports the front portion and swings the front according to the rear with the front swinging system which sways the front part. In addition, the front swinging system which sways the front portion between a substantially horizontal position and a forward sloping position against the rear portion can be attached, as well as a movable slope member, which sways freely around the third horizontal axis. Also provided is a connecting material which sways the lower portion in accordance with the swinging of the front part and another connecting material which sways the movable slope member from the substantially vertical position to that of a forward sloping position against the front portion in accordance with the swinging of the front portion.

It is to be noted that the member running along the first, second or third horizontal axis can be a rod, hinge or the like.

Blocking materials can be placed at any desirable place on the upper parking space.

In the present invention, by sliding down the parking structure with the main swinging system and lowering its front portion, the floor of the upper parking is brought down to the road level and thus, the entering or leaving of automobiles is facilitated. On the other hand, by sliding the parking structure upward and ascending the lower portion, the floor of the lower portion is brought up to a road level and likewise, an automobile can easily enter or leave.

These and other features of the invention will be understood upon reading of the following description along with the drawings.

DESCRIPTION OF THE PREFERRED EMBODIMENT

Figure 1:
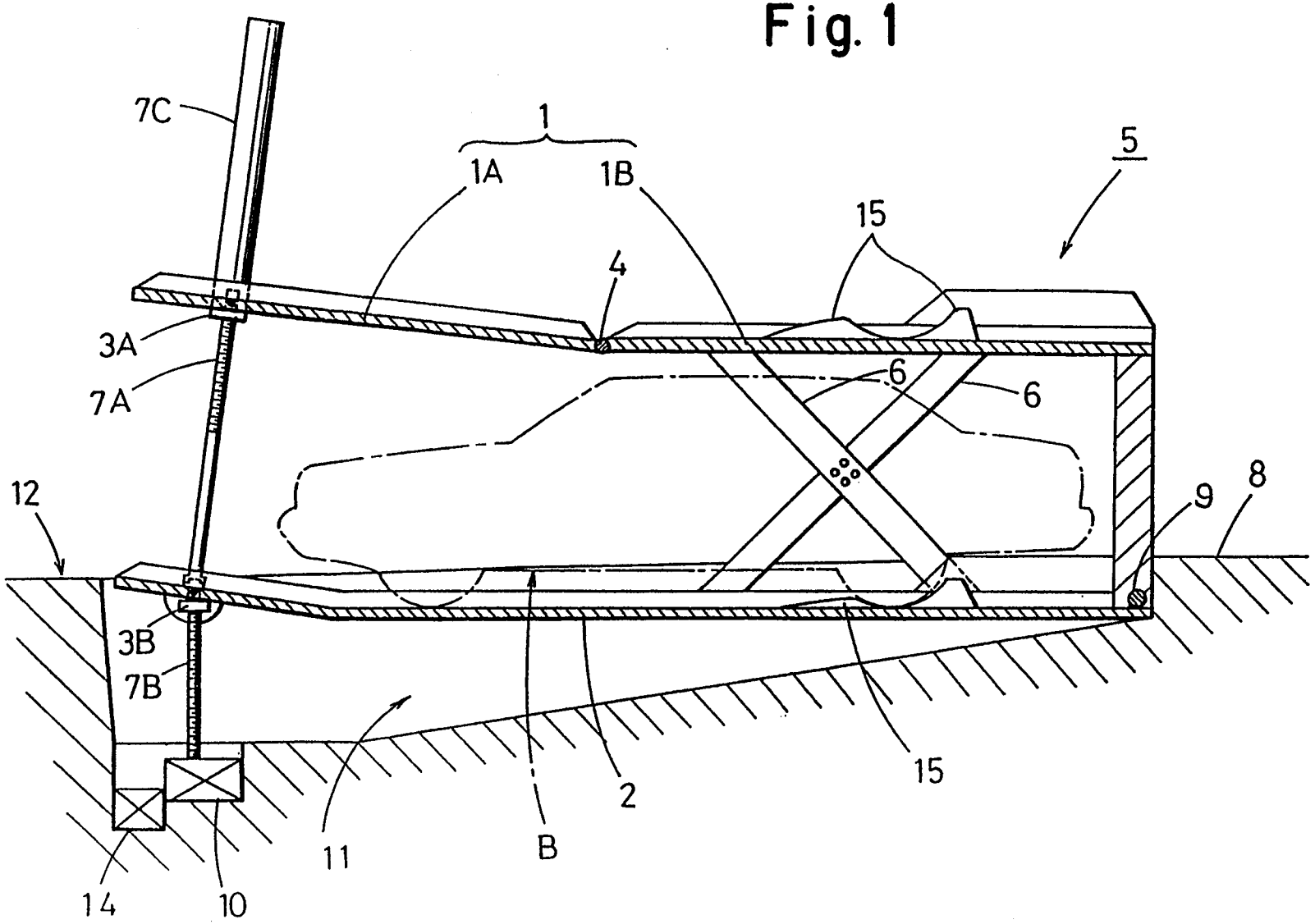
FIG. 1 is a side view of a three-dimensional parking structure embodying the present invention when an automobile enters and leaves a lower parking space.
Figure 2:
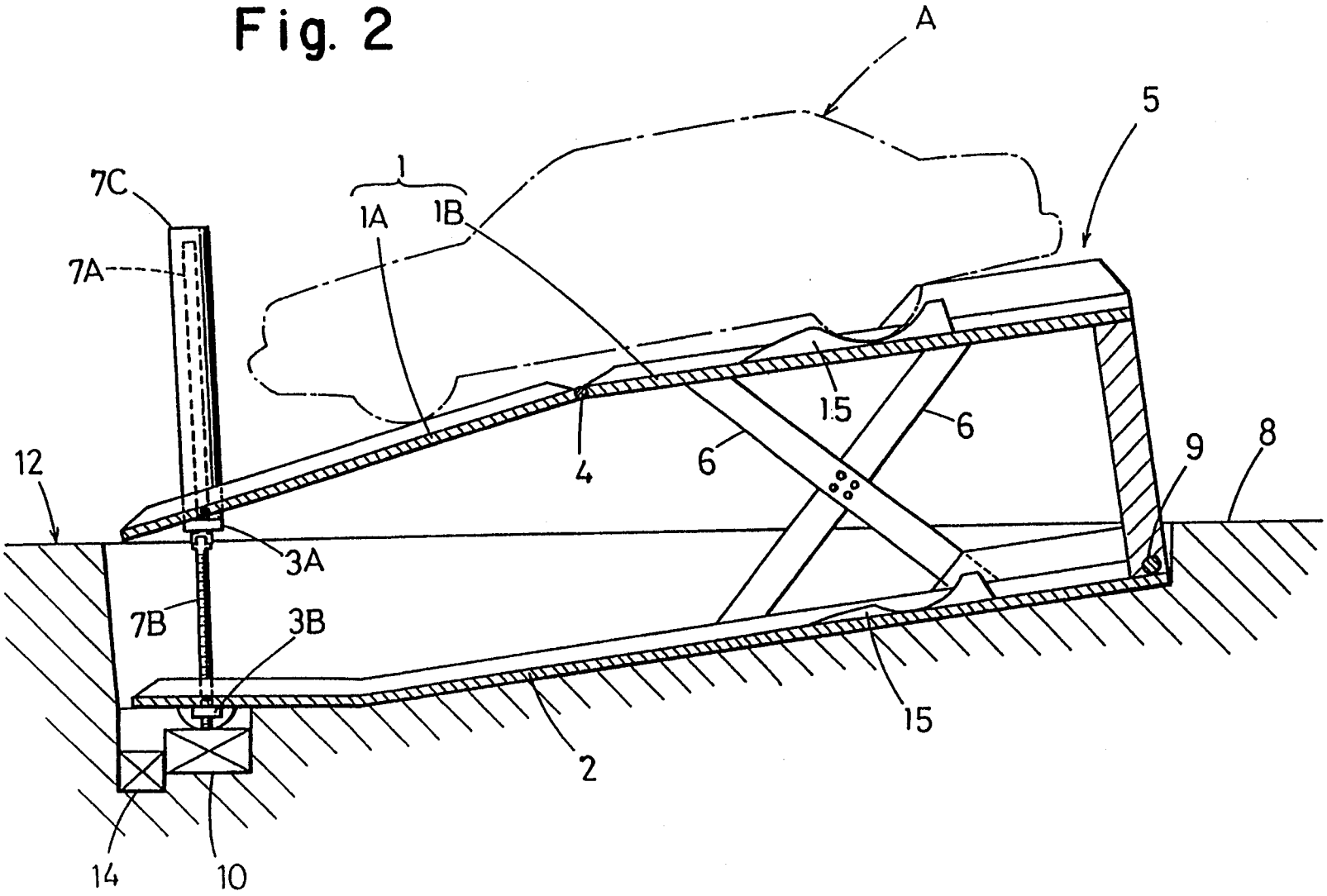
FIG. 2 is a side view of the same structure shown in FIG. 1 when and automobile enters and leaves an upper parking space.
Figure 3:
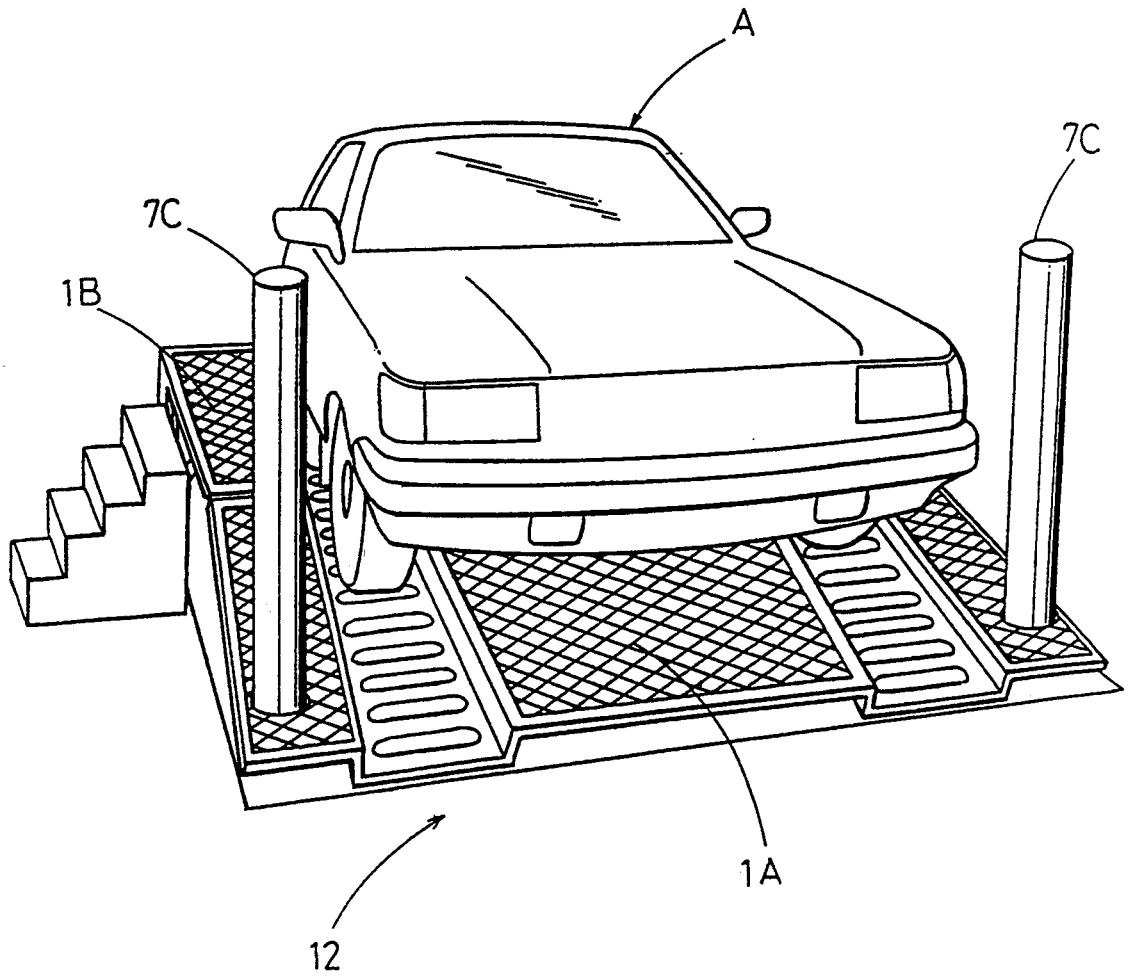
FIG. 3 is a perspective view of the same structure shown in FIGS. 1 and 2 when an automobile enters and leaves the upper parking space.

FIG. 1 is a side view of a three-dimensional parking structure embodying the present invention when an automobile enters and leaves a lower parking space. FIG. 2 is a side view of the same structure when an automobile enters and leaves an upper parking space. FIG. 3 is a perspective view of the same structure when an automobile enters and leaves the upper parking space.

In each of FIGS. 1, 2 and 3, reference number 1 is an upper parking palette forming the upper parking space, reference number 2 is a lower parking palette forming the lower parking space, reference number 1A is a free-swaying swing plate which includes the front portion of the upper parking palette which is supported by a member running along a second horizontal axis or a subswinging axis 4 to the rear portion of the upper parking palette 1.

The two-layered parking unit 5 forming the parking structure is made up of an upper parking palette 1 and a lower parking palette 2. In this two-layered parking unit 5, the rear portion of the upper parking palette 1 is supported by the post 6 to the lower parking palette 2, while the swing plate 1A is supported by the sub-swinging axis 4 to the rear portion of the palette and swings vertically. The two-layered parking unit 5 is itself supported by a member running along a first horizontal axis or main vibratory axis 9 to a solid foundation 8 and swings freely.

Nuts 3A, 3B support the swing plate 1A and the lower parking palette, respectively, and screws 7A, 7B are inserted as joint materials to each of the nuts 3A, 3B; and both screws 7A, 7B are connected as universal joints. The end of the rear screw 7B is supported by the thrust at the bottom of an underground pit 11 and is spun around by the revolving apparatus 10, such as, a gear motor. This structural arrangement corresponds to the front swinging system.

The pitch of screw 7A and nut 3A is about 60 cm by about 80 rounds, and that of screw 7B and nut 3B is about 80 cm by about 80 rounds.

The underground pit 11, as a space below the structure of this invention, is dug into a level lower than a road 12 so that the lower parking palette can be buried or placed below the road level. This underground pit 11 is not in the shape of a rectangular prism, but the bottom is rather sloping downward; thereby requiring only a small amount of digging.

For instance, since the conventional three-dimensional parking facility requires a pit of approximately 1.5 m deep, a space of about 25.2 cubic meters had to be dug in order to secure the parking space of 15 square meters. However, the three-dimensional parking facility of this invention only requires an underground pit which is about 70 cm at the deepest end and about 10 cm at the shallowest end; and thus, a mere 6 cubic meters worth of digging is sufficient, which means only about 24% of the amount of digging compared to the conventional facilities.

FIG. 1 shows a structural arrangement whereby the two-layered parking unit 5 is lifted.

When screws 7A, 7B are revolved about 80 times by the revolving apparatus which makes up the front swinging system due to the difference in the pitches, nut 3A of swing plate 1A rises by about 60 cm, while nut 3B of swing plate 1B rises by about 80 cm.

Thus, the entrance where the road level and the level of the lower parking space meet or the entrance or exit level of the lower portion is high enough for an automobile to enter and exit.

FIG. 2 shows a structural arrangement whereby the two-layered parking unit is lowered.

When screws 7A, 7B are reversed about 80 times, the revolving apparatus 10 due to the difference in the pitches, nut 3A of swinging plate 1A goes down by about 60 cm, while nut 3B of swing plate 1B goes down by about 80 cm. The swinging of the two-layered parking unit 5 and swing plate 1A changes the angles of screws 7A and 7B at the connecting universal joint. Since screw 7A is supported by swing plate 1A and sways freely, it is driven smoothly. Screw 7B and the lower parking palette 2 relate to each other in the same above-described manner.

Accordingly, the entrance road level 12 meets the swing plate 1A, and facilitates the entrance and the exit of automobiles.

Reference number 7C refers to a screw cover which covers screw 7A for safety reasons.

FIG. 3 shows a front view of an automobile A entering or leaving the three-dimensional parking structure of the present invention.

The elements for the front swinging system are not limited to the revolving screws and nuts which correspond to screws, but a main oil-pressured cylinder which sways the entire two-layered parking unit 5, and a sub oil-pressured cylinder which only sways swing plate 1A, as well as a chain power, may also be used.

Instead of digging an underground pit, an entire two-layered parking unit 5 can be placed on the ground and an entering slope can be constructed.

In order to reinforce each floor, a rib can be utilized. For further reinforcement, the part of the floor where an opening of a door of a driver's seat does not matter should be in a truss structure.

Since the pit of this invention is shallower than a conventional one, it is less humid inside; and thus, rust is prevented from developing on automobiles parked therein or on machinery, and decreases submergence. Moreover, a drainage 14 removes the leaks from the underground pit and makes the use thereof even more comfortable.

Additionally, a tire stopper 15 prevents an automobile from retreating too far or from moving when a floor is sloped downward; thereby, enhancing safety. The revolving apparatus 10 can be operated by remote control. Moreover, the parking facility can be entirely covered with a roof.

As the foregoing description shows, the three-dimensional parking facility of this invention decreases the amount of digging to about 24% as compared to the conventional underground pit with a lesser amount of construction expense and lesser material for reinforcing the wall of an underground pit.

The following is a description of an embodiment of a three-dimensional parking facility with a mobile plate.

Figure 4:
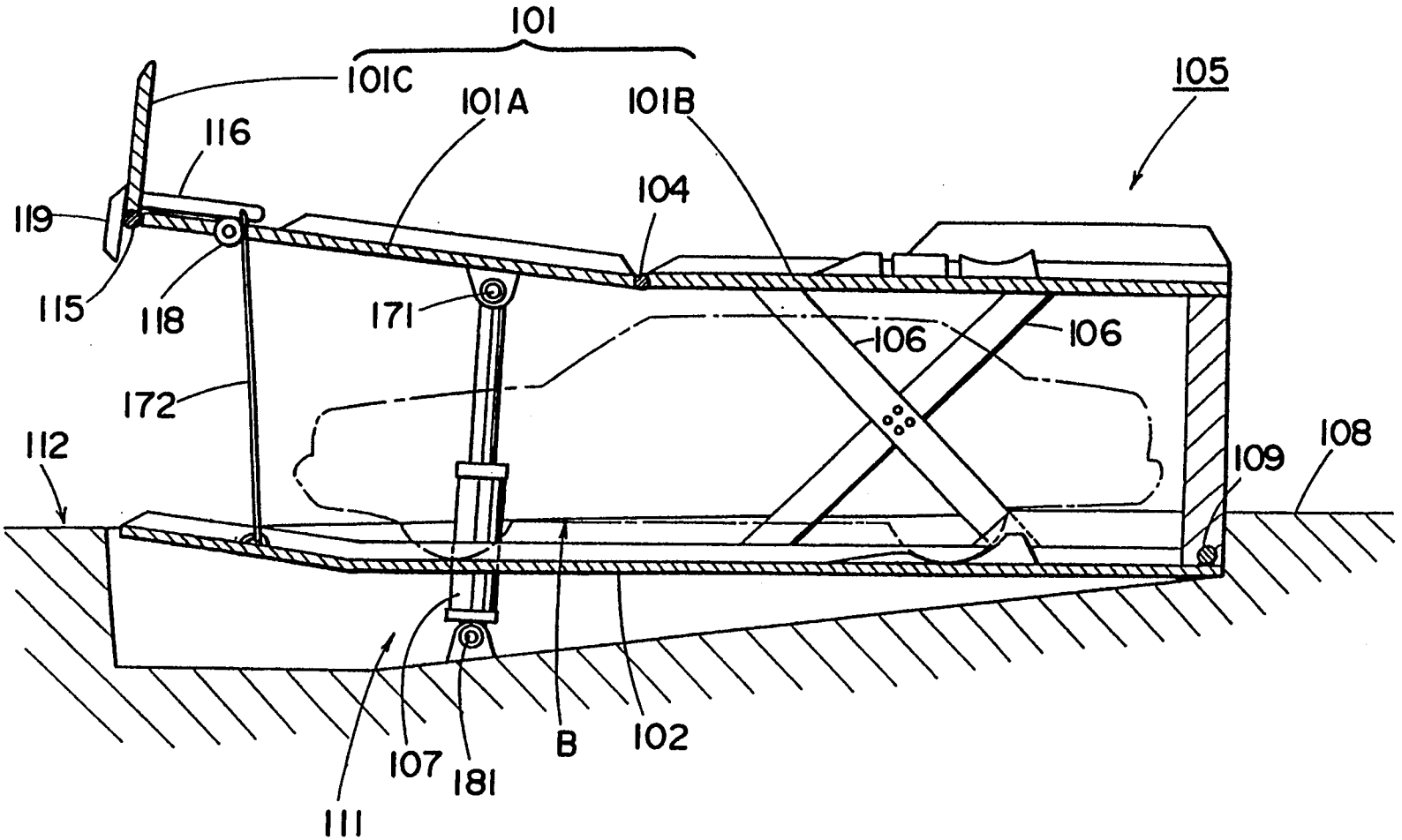
FIG. 4 is a side view of the three-dimensional parking structure of this invention with a movable plate when an automobile enters and leaves the lower parking space.

FIG. 4 is a side view of the lower portion of three dimensional parking structure of this invention shown in a position when an automobile enters or leaves.

Figure 5:
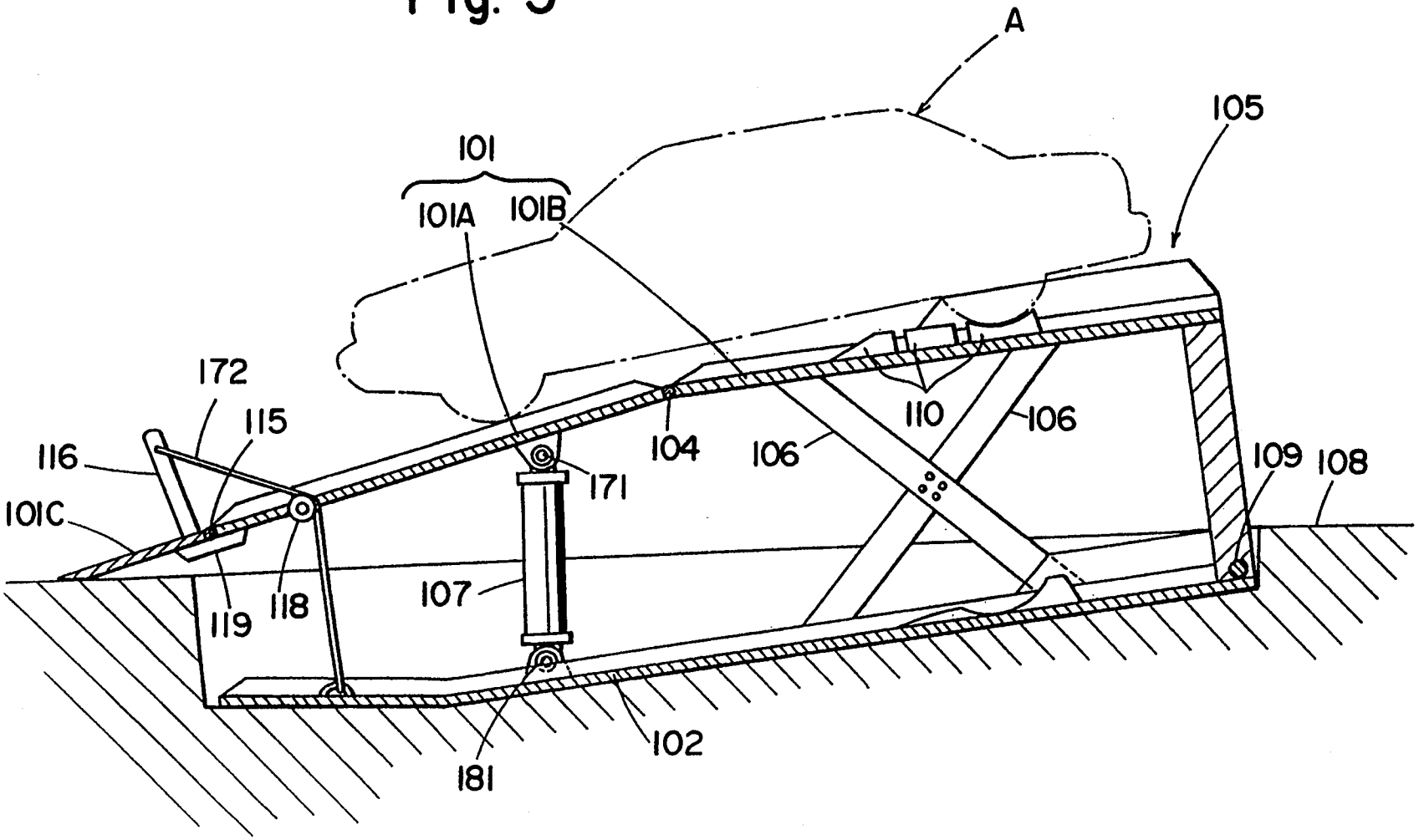
FIG. 5 is a side view of the same structure of this invention, as shown in FIG. 4, when an automobile enters and leaves the upper parking space.

FIG. 5 is a side view of the upper portion of the three-dimensional parking structure of this invention shown in a position when an automobile enters or leaves.

In FIGS. 4 and 5, reference number 101 is an upper parking palette used in the upper parking space, reference member 102 is a lower parking palette used in the lower parking space, and to reference number 101A is a free-swaying swing plate which is part of the front portion of the upper parking palette and is supported by a member running along the second horizontal axis 104 to the rear part 101B of the upper parking palette 101. Reference number 101C designates a movable slope member which is supported by a member running along a third horizontal axis 115 to the swing plate 101A. The two-layered parking unit 105 when used as a parking structure is made up of the upper parking palette 101 and the lower parking palette 102.

In this two-layered parking unit 105, the rear portion of the upper parking palette 101 is supported by the post 106 to the lower parking palette 102. The upper parking palette 101 and the lower parking palette 102 are fixed to each other and make up a C-shape member. The two-layered parking unit 105 itself is supported by a member running along a first horizontal axis 109 to a solid foundation 108 and swings freely.

An oil-pressured cylinder 107, as part of the front swinging system, is placed between an action point 171 of swing plate 101A and the base 181. The oil-pressured cylinder 107 is supported at the action point 171 and the base 181, and revolves freely.

A wire rope 172, as a joint material, with one end being fixed to the post 116 located near a third horizontal axis 115 is fixed to the lower parking palette 102 through a pulley member 118 or the like at swing plate 101A. The range of movement of the movable slope member 101C is from a vertical position to a substantially horizontal position because of a post 116 on the top end portion of the swing plate 101A, and the stopper 119 at the reverse side of the swing plate 101A.

The underground pit 111 is about 50 cm lower than the level of the entrance 112 so that the bottom of the lower parking palette 102 can be buried or can be located below the road level. This underground pit does not have to be in the shape of a rectangular prism which is about 50 cm deep; rather, the under-ground pit can have a sliding bottom portion which can decrease the required amount of digging. For instance, an underground pit which is about 70 cm at the deepest end and about 10 cm at the shallowest end is sufficient which means that a mere one-third or one-fourth of the amount to be dug is required as compared to the conventional underground pits.

The designs of the two-layered parking unit 105, along with the shape and size of an underground pit 111, can vary according to the style or size of automobiles to be parked. Depending on the condition of the location, the entire two-layered parking unit 105 can be placed above ground without an underground pit 111.

FIG. 4 shows the two-layered parking unit 105 of this invention when it is lifted. The two-layered parking unit 105 is lifted from the sloping-forward position when an automobile enters or leaves the lower level.

Once the oil-pressured cylinder 107 functions, swing plate 101A starts to rise. Then, the loosened wire rope 172 begins to tighten which makes the movable slope member 101C start revolving around the third horizontal axis 115. Since the movable slope 101C stops revolving at the point where the post 116 touches the upper part of swing plate 101A, if the oil-pressured cylinder 107 is further stretched, the wire rope 172 starts to lift the lower parking palette 102. In this manner, the upper parking palette 101 and the lower parking palette 102 move together around the first horizontal axis 109 and the lower parking palette rises. Then, the entrance road level 112 and the level of the entrance of the lower parking palette 102, and the upper-limit switch is operated; thereby, stopping the oil-pressured cylinder 107. Accordingly, the height for providing an entrance and an exit for the lower parking space is secured; thereby, facilitating the entering and leaving of automobiles.

FIG. 5 shows the two-layered parking unit 105 when it is lowered. The two-layered parking unit 105 is lowered from the lifted position when an automobile enters or leaves the lower portion.

Once the valve of the oil-pressured cylinder 107 is opened and the pressure is released, the upper parking palette 101 and the lower parking palette 102 move together around the first horizontal axis 109 and the front part of the lower parking palette 102 is moved down. When the lower parking palette 102 hits the underground pit 111, the tightened wire rope 172 slightly loosens and swing plate 101A begins to descend. The front portion of the movable slope member 101C starts to descend around the third horizontal axis 115, and the lower-limit switch functions at the point when the tip of swing plate 101A meets the entrance road level which also closes by the time the stopper 119 touches the reverse side of the swing plate 101A.

This then brings swing plate 101A and the entrance road 112 into a single slope and thus, facilitating the entering and leaving of automobiles.

Since too long a movable slope member 101C has some adverse effects, the length of between about 30 cm and 50 cm is ideal depending on the condition of the location.

As shown in FIGS. 4 and 5, the upper parking palette 102 is made up of two rows of a plurality of block materials 110. Since this structure enables the rear tire of a car to get on the block materials 110 when it enters or leaves, the member running along the second horizontal axis 104 does not touch the floor of the car. The shape, position or number of these block materials depend on the height of the floor and the length of the wheel bases of automobiles to be parked.

It is to be noted that the member running along the first horizontal axis 9, 109, the second horizontal axis 4, 104, and the third horizontal axis 115 can be a rod, hinge or the like.

The front swinging system is not limited to the oil-pressured cylinder, but revolving screws and nuts which correspond to screws, as well as chain power, may also be used.

In order to reinforce each floor, a reinforcing rib 113 can be used. For additional reinforcement, the part of the floor where the opening of a door of a driver's seat does not have to be considered is in a truss structure.

Since the pit of this invention is shallower than a conventional one, it is less humid inside; thereby, preventing rust from developing on automobiles parked therein or on machinery, and decreasing submergence. A drainage 14 removes the leak from the underground pit, and makes the use thereof even more comfortable.

The joint material can be chain or rods, instead of a wire rope 172.

Additionally, a tire stopper on the lower portion can be used to prevent an automobile from retreating too far or from moving when a floor is sloped down and thus, enhances the safety of this invention when in use. The oil-pressured cylinder can be operated by remote control. Moreover, the parking facility of this invention can be entirely covered by a roof.

The two-layered parking unit 105 is placed above ground without digging an underground pit and a slope can be constructed at the entrance. More particularly, when several sets of three-dimensional parking structures are placed, they are placed on the ground, without digging, and with a common entrance slope.

As the foregoing description shows, this three-dimensional parking facility decreases the amount of digging required for an underground pit to one third or one fourth of conventional ones and with a lesser amount of construction expense and with lesser material for reinforcing the wall of an underground pit.

While the invention has been particularly shown and described in reference to preferred embodiments thereof, it will be understood by those skilled in the art that changes in form and details may be made therein without departing from the spirit and scope of the invention.

What is claimed is:

1. A three-dimensional parking facility, comprising:

an upper parking member and lower parking member respectively coupled to opposing ends of an upstanding member so as to form a substantially C-shaped member extending from a front portion of said upper parking member through said upstanding member and a front portion of said lower parking member, a vehicle entering or exiting to or from at least one of said front portions of said upper and lower parking members;

means for swinging said upper parking member and said lower parking member, said C-shaped member being pivoted on a first horizontal axis on a solid foundation, said upper parking member having a front portion and a rear portion which are separated by a second horizontal axis; and means, operably coupled to said solid foundation, for swinging said front portion of said upper parking member, wherein the first horizontal axis is at a lower end of the upstanding member, and is substantially at ground level, and wherein the foundation has a portion that is downwardly sloped toward an open end of the C-shaped member and the downwardly sloped portion of the foundation originates from substantially ground level proximate the first horizontal axis.

2. A three-dimensional parking facility, comprising:

an upper parking member and a lower parking member respectively coupled to opposing ends of an upstanding member so as to form a substantially C-shaped member extending from a front portion of said upper parking member through said upstanding member and a front portion of said lower parking member, a vehicle entering or exiting to or from at least one of said front portions of said upper and lower parking members, said C-shaped member being pivoted on a first horizontal axis on a solid foundation, said upper parking member having a front portion and a rear portion which are separated by a second horizontal axis;

means, operably coupled to said solid foundation, for swinging said front portion of said upper parking member; and a joint means, operably coupled to said front portions of said upper and lower parking members, for swinging said lower parking member in accordance with the swinging of said front portion of said upper parking member, wherein the first horizontal axis is at a lower end of the upstanding member, and is substantially at ground level, and wherein the foundation has a portion that is downwardly sloped toward an open end of the C-shaped member and the downwardly sloped portion of the foundation originates from substantially ground level proximate the first horizontal axis.

3. A three-dimensional parking facility, comprising:

an upper parking member and a lower parking member respectively coupled to opposing ends of an upstanding member so as to form a substantially C-shaped member extending from a front portion of said upper parking member through said upstanding member and a front portion of said lower parking member, a vehicle entering or exiting to or from at least one of said front portions of said upper and lower parking members;

means for swinging said upper parking member and said lower parking member, said C-shaped member being pivoted on a first horizontal axis on a solid foundation, said upper parking member having a front portion and a rear portion which are separated at a second horizontal axis above a windshield of an automobile to be parked on said lower parking member; and means, operably coupled to said solid foundation, for swinging said front portion of said upper parking member, wherein the first horizontal axis is at a lower end of the upstanding member, and is substantially at ground level, and wherein the foundation has a portion that is downwardly sloped toward an open end of the C-shaped member and the downwardly sloped portion of the foundation originates from substantially ground level proximate the first horizontal axis.

4. A three-dimensional parking facility, comprising:

an upper parking member and a lower parking member respectively coupled to opposing ends of an upstanding member so as to form a substantially C-shaped member extending from a front portion of said upper parking member through said upstanding member and a front portion of said lower parking member, a vehicle entering or exiting to or from at least one of said front portions of said upper and lower parking members, said C-shaped member being pivoted on a first horizontal axis on a solid foundation, said upper parking member having a front portion and a rear portion which are separated at a second horizontal axis above a windshield of an automobile to be parked on said lower parking member;

means, operably coupled to said solid foundation, for swinging said front portion of said upper parking member; and a joint means, operably coupled to said front portions of said upper and lower parking members, for swinging said lower parking member in accordance with the swinging of said front portion of said upper parking member, wherein the first horizontal axis is at a lower end of the upstanding member, and is substantially at ground level, and wherein the foundation has a portion that is downwardly sloped toward an open end of the C-shaped member and the downwardly sloped portion of the foundation originates from substantially ground level proximate the first horizontal axis.

5. A three-dimensional parking facility, comprising:

an upper parking member and a lower parking member respectively coupled to opposing ends of an upstanding member so as to form a substantially C-shaped member extending from a front portion of said upper parking member through said upstanding member and a front portion of said lower parking member, a vehicle entering or exiting to or from at least one of said front portions of said upper and lower parking members;

means for swinging said upper parking member and said lower parking member, said C-shaped member being pivoted on a first horizontal axis on a solid foundation, said upper parking member having a front portion and a rear portion which are separated at a second horizontal axis above a windshield of an automobile to be parked on said lower parking member;

means, operably coupled to said solid foundation, for swinging said front portion of said upper parking member between a substantially horizontal position and a sloping-forward position relative to said rear portion;

a movable member, rotatably mounted onto said front portion of said upper parking member, which freely swings around a third horizontal axis at a top portion of said front portion; and means for swinging said movable member between a substantially vertical position and a forward-sloping position relatively to said rear portion, wherein the first horizontal axis is at a lower end of the upstanding member, and is substantially at ground level, and wherein the foundation has a portion that is downwardly sloped toward an open end of the C-shaped member and the downwardly sloped portion of the foundation originates from substantially ground level proximate the first horizontal axis.

6. A three-dimensional parking facility, comprising:

an upper parking member and a lower parking member respectively coupled to opposing ends of an upstanding member so as to form a substantially C-shaped member extending from a front portion of said upper parking member through said upstanding member and a front portion of said lower parking member, a vehicle entering or exiting to or from at least one of said front portions of said upper and lower parking members, said C-shaped member being pivoted on a first horizontal axis on a solid foundation, said upper parking member having a front portion and a rear portion which are separated at a second horizontal axis above a windshield of an automobile to be parked on said lower parking member;

means, operably coupled to said solid foundation, for swinging said front portion of said upper parking member between a substantially horizontal position and a sloping-forward position relative to said rear portion;

a movable member, rotatably mounted onto said front portion of said upper parking member, which freely swings around a third horizontal axis at a top portion of said front portion;

a joint means, operably coupled to said front portions of said upper and lower parking members, for swinging said lower parking member in accordance with the swinging of said front portion of said upper parking member; and another joint means for swinging said movable member from a substantially vertical position to a forward-sloping position in accordance with the swinging of said front portion of said upper parking member, said another joint means swinging said movable member relative to said front portion, wherein the first horizontal axis is at a lower end of the upstanding member, and is substantially at ground level, and wherein the foundation has a portion that is downwardly sloped toward an open end of the C-shaped member and the downwardly sloped portion of the foundation originates from substantially ground level proximate the first horizontal axis.

7. The three-dimensional parking facility as set forth in one of claims 1–6, wherein said upper parking member includes vehicle blocking members.

8. The three-dimensional parking facility as set forth in one of claims 1–6, wherein said upper parking member includes removable vehicle blocking members.

9. The three-dimensional parking facility as set forth in one of claims 1–6, wherein the upper parking member and the lower parking member are substantially parallel and fixed relative to each other, and are joined at ends thereof by the substantially upstanding member.

10. The three-dimensional parking facility as set forth in one of claims 1–6, wherein the front portion of the upper parking member is pivotable at a location beyond a fixed brace means, and wherein the swinging means is connected between the foundation and the front portion of the upper parking member.

* * * * *